US005768915A

United States Patent [19]

Crumrine et al.

[11] Patent Number: 5,768,915

[45] Date of Patent: Jun. 23, 1998

[54] COIN DISPLAY DEVICE

[75] Inventors: David Crumrine, Reno; Daniel J. Mitchell; Matthew A. Taber, both of Sparks, all of Nev.

[73] Assignee: Crumrine Manufacturing Jewelers, Inc., Reno, Nev.

[21] Appl. No.: 649,899

[22] Filed: May 2, 1996

[51] Int. Cl.[6] ..... A44C 17/02

[52] U.S. Cl. ..... 63/29.1; 24/163 K

[58] Field of Search ..... 63/29.1, 21, 1.11, 63/1.19; 24/163 K, 163 R, 163 FC; 224/163

[56] References Cited

U.S. PATENT DOCUMENTS 1,429,641 9/1922 Sayko .
2,840,875 7/1958 Chambers .
4,377,939 3/1983 Reinsdorf .
4,570,308 2/1986 Weisgerber .
4,742,696 5/1988 Jenkins ..... 63/29.1
4,972,557 11/1990 Williams .

*Primary Examiner*—Kien T. Nguyen
*Attorney, Agent, or Firm*—Skjerven, Morrill, MacPherson, Franklin & Friel; David W. Heid

[57] ABSTRACT

An artifact retaining device for holding a coin or the like in a display structure such as a belt buckle. A bezel with a detent is retained on the outside front surface of the display structure and is held in place by a detent on a retaining member that is inserted through an opening of the belt buckle and engages the detent on the bezel. The bezel and retaining member have display windows through which the front and rear face of the coin can be viewed. The bezel, coin, and retaining member are removable from the buckle.

11 Claims, 9 Drawing Sheets

COIN DISPLAY DEVICE

BACKGROUND OF THE INVENTION

1. Field of the Invention

The present invention relates generally to a coin, a stone or any artifact display and mounting structure, and more particularly, to coin display buckles and jewelry, jewelry with stones, and various artifacts of art or advertising of any shape which in this new retaining device the items above and the like, can be securely retained or removed and/or replaced.

2. Description of the Prior Art

It is common practice to issue commemorative coins or coin type mementoes such as medals or the like (all of these together with conventional coins hereinafter referred to as "coins") to commemorate or celebrate a particular event or occasion. The recipients of such commemorative coins generally wish to prominently display them in their places of business, their homes, or on their persons. There have been numerous types of display structures including suitable frames, cabinets, etc., but one of the most popular display structure has been a belt buckle or the like in which the coin is retained in an opening on the buckle by a coin retaining bezel.

In one such attachment means, the bezel is permanently secured to the front face of the belt buckle, with the coin being held to the bezel by a plurality of tabs or one or more peripheral edge portions which are bent over an outer edge of the coin after it has been inserted. In a second attachment means, a coin frame is attached to the front of the buckle with bolts and nuts. In another attachment means, disclosed in U.S. Pat. No. 4,972,557, the bezel is insertable through an opening in the belt buckle and is fastened to the belt buckle by either soldering or by having flutes on the bezel and press fitting the bezel into the opening.

There are several undesirable features in the above identified prior art methods of securing a coin to a belt buckle or the like. First, the coin retaining bezels in some of the prior art are attached to the front face of the buckle. Thus, the coin is raised above the belt buckle by an amount at least as much as the coin thickness plus the bezel thickness. This results in a coin display which is generally unattractive because the coin looks like an add-on to the belt buckle rather than being designed into the overall product appearance. Secondly, in some of these prior art methods the belt buckle coin holders are intended to permanently retain the coin in the belt buckle or to permit only a limited number of removals or replacements. For example, some of these belt buckle coin holders include a plurality of tabs or edge portions which are bent over the peripheral edge of the coin after it has been inserted. If removal of the coin is desired, the tabs or edge portions must be bent back. This repeated bending of the tabs or edge portions not only results in deformation of the tabs or edge portions, and thus general unattractiveness of the coin holder, but can also result in the tabs or edge breaking off or becoming permanently distorted. Thirdly, some of these prior belt buckle coin holders permit viewing of only one side of the coin.

In other prior art methods, such as that shown in U.S. Pat. No. 4,972,557, the only means retaining the bezel in the opening is the friction between the bezel and the opening or the solder. If either of these fail the bezel will fall out of the opening with the possible loss of the coin. On the other hand, if the solder and force fit is good, once the bezel is in the opening, it is generally not readily removable in case the face of the bezel is damaged or in case a different coin or a different size coin is desired to be displayed.

Accordingly, there is a need in the art to provide an improved coin holder for a belt buckle or the like in which the coin is mounted and retained in the belt buckle at a position which is generally flush with the front surface of the buckle or which gives the appearance of being designed into the buckle. There is also a need in the art to provide a coin holder for a belt buckle or the like in which the coin and the coin retaining device can be repeatedly removed and replaced without distortion of the coin holding mechanism or the belt buckle in case the face of the bezel is damaged or it is desired to display a different sized coin. By being able to replace the coin retaining device different diameter coins as well as different thickness coins can be displayed in the same belt buckle.

SUMMARY OF THE INVENTION

A coin retaining device for a coin display structure, such as a belt buckle, with a bezel retained on the outside of the front surface of the structure and a retaining member engaging the bezel to hold it in place.

The bezel is provided with a detent which is engageable with a detent provided in the retaining member. The bezel has an opening through which the front surface of the coin or the like can be viewed and the retaining member may have an opening which allows the back surface of the coin or the like to be viewed.

The bezel and the retaining member have cooperative dimensions to retain the coin or the like disposed between the bezel and the retaining member.

The bezel and the retaining member are readily and easily removable from the display structure.

Other display structures include structures suspended from a necklace or charm bracelet and rings.

The present invention is better understood upon consideration of the detailed description below, in conjunction with the accompanying drawings. As will become readily apparent to those skilled in this art from the following description there is shown and described a preferred embodiment of this invention simply by way of illustration of the mode best suited to carry out the invention. As it will be realized, the invention is capable of other different embodiments, and its several details are capable of modifications in various, obvious aspects all without departing from the scope of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate the present invention, and together with the description serve to explain the principles of the invention. In the drawings.

DETAILED DESCRIPTION OF THE PREFERRED EMBODIMENT

Figure 1:
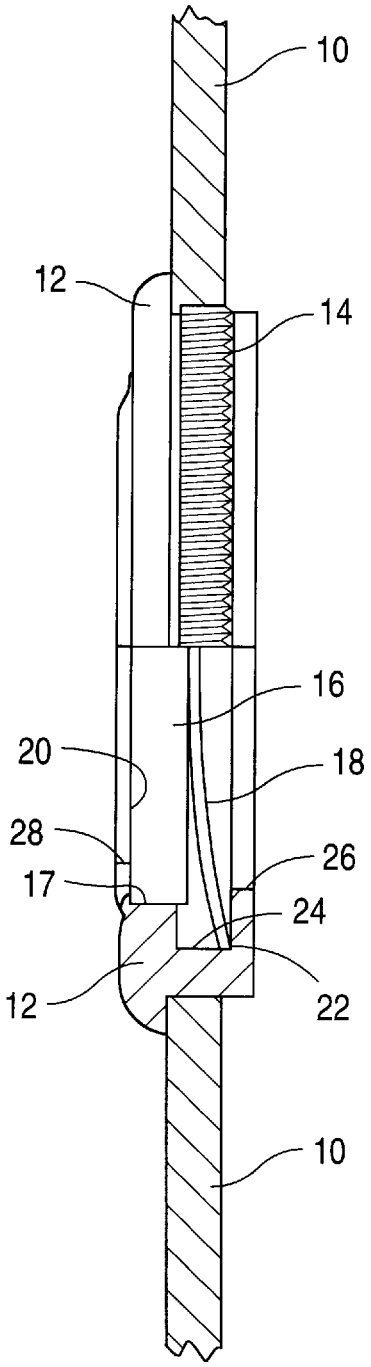
FIG. 1 (PRIOR ART)
FIG. 1 shows a prior art belt buckle and a coin retaining bezel and clip.

Referring now to FIG. 1, there is shown a prior art belt buckle which is disclosed in U.S. Pat. No. 4,972,557. A portion of belt buckle 10 is shown with bezel 12 in place. Flutes 14 on bezel 12 hold bezel 12 when press-fit into an opening in belt buckle 10. Other methods of securing bezel 12 are disclosed in U.S. Pat. No. 4,972,557, such as soldering. Coin 16 is seated on an annular surface 17. A retaining clip 18 holds coin 16 against the front surface 20 of bezel 12. Clip 18 is seated in a corner 22 formed by an annular surface 24 and a back surface of bezel 12 defined by an annular surface 26 and holds coin 16 in place by spring tension. In addition, annular surface 26 defines an opening in the rear surface of bezel 12 through which the rear face of coin 16 can be seen. Annular surface 28 defines an opening through which the front face of coin 16 can be viewed.

Figure 2:
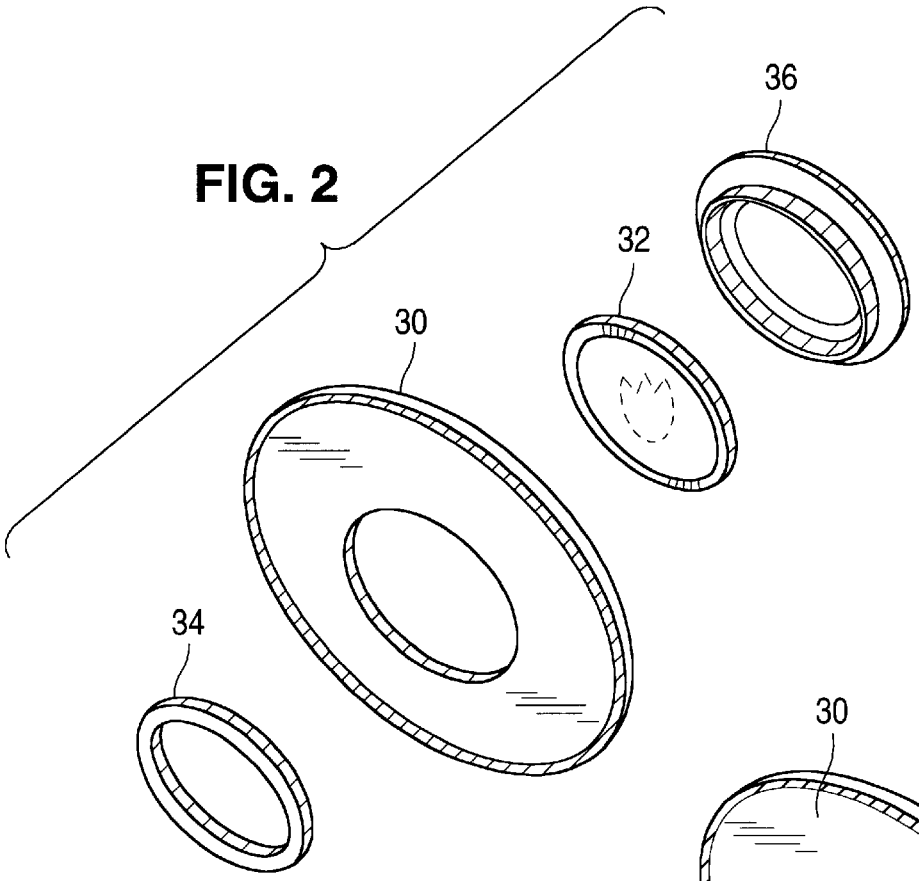
FIG. 2 is an exploded view of a first embodiment of the present invention.
Figure 3:
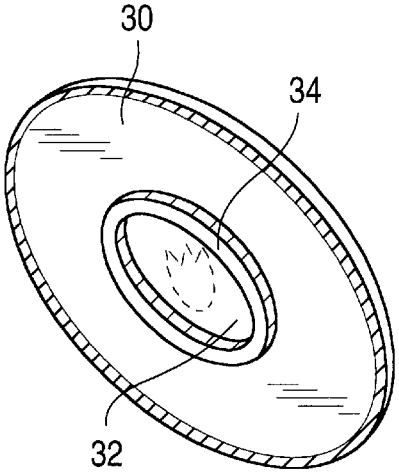
FIG. 3 shows the front side of a belt buckle with the coin retaining device shown in FIG. 2 in place.
Figure 4:
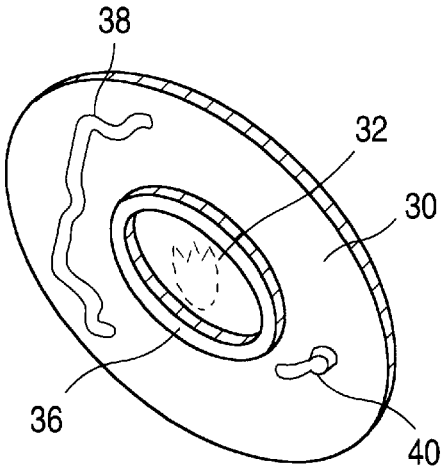
FIG. 4 shows the back side of the belt buckle shown in FIG. 3 with the coin retaining device shown in FIG. 2 in place.

Referring now to FIG. 2, there is shown an exploded view of belt buckle 30, coin 32, bezel 34, and retaining member 36 of the present invention. FIG. 3 shows the front of belt buckle 30 with coin 32 and bezel 34 in place. FIG. 4 shows the back of belt buckle 30 with coin 32 and retaining member 36 in place. Conventional belt buckle hardware 38 and 40 are attached to the back of buckle 30.

Figure 5:
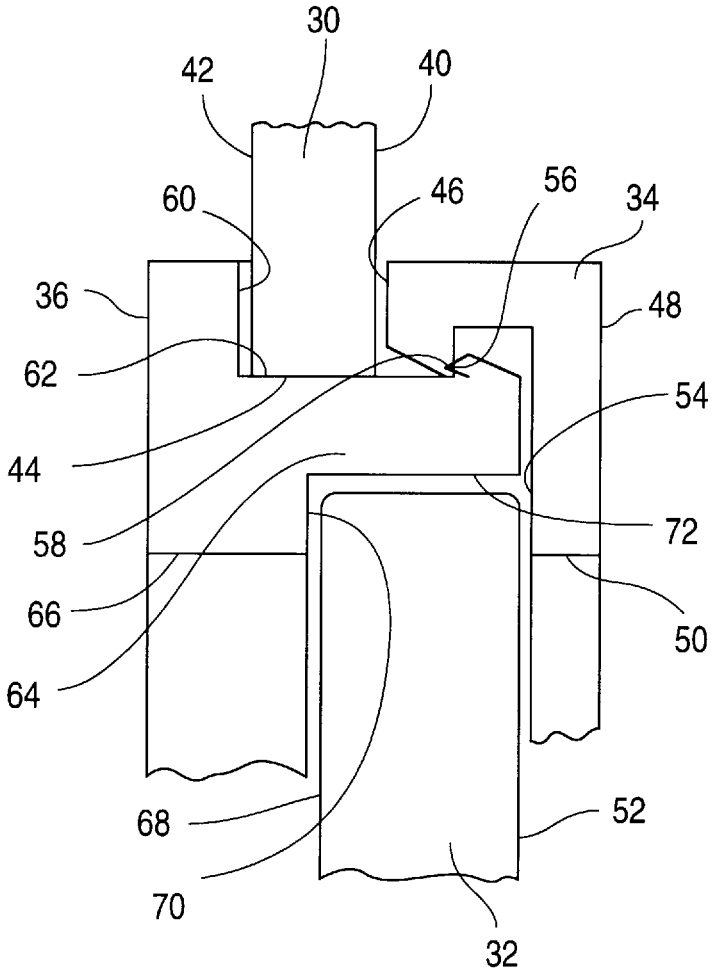
FIG. 5 is an enlarged view of a portion of the coin retaining device shown in FIG. 2.

Referring now to FIG. 5, there is an enlarged view showing how belt buckle 30, bezel 34, and retaining member 36 interface and interact to retain coin 32 in place. Buckle 30 has a front surface 40 and a back surface 42 and an opening defined by a surface 44. Bezel 34 has a surface 46 which is held flush against front surface 40 of buckle 30. It is noted that in FIG. 5 there is shown a space between surface 46 and surface 40, however, this is for illustrative purposes only. It is noted that throughout FIG. 5 there are shown spaces between surfaces on the belt buckle 30, bezel 34, retaining member 36, and coin 32. These spaces are shown for illustrative and clarity purposes only and as can be appreciated by one of ordinary skill in the art when the structure is put together the components mate securely together which is the intent of the invention.

Referring again to FIG. 5, bezel 34 has a front face 48 and a surface 50 which defines an opening which is a display window through which the front face 52 of coin 32 can be viewed. It is also contemplated that a clear protective film (not shown) could be positioned between the front face 52 and a rear surface 54 of bezel 34. Bezel 34 has an inwardly facing detent 56 which engages an outwardly facing detent 58 on retaining member 36. Retaining member 36 has a surface 60 that is held flush against rear surface 42 of buckle 30. Retaining member 36 has an outer surface 62 sized to fit within the opening in buckle 30 defined by surface 44. As shown in FIG. 5, the outwardly facing detent 58 on retaining member 36 has a dimension larger than the dimension defined by surface 44 in buckle 30. To allow retaining member 36 to be insertable in the opening in buckle 30 retaining member 36 is made of a deformable material such that section 64 will flex to allow detent 58 to be insertable in buckle 30. A surface 66 on retaining member 36 defines an opening through which the rear face 68 of coin 32 can be viewed. Retaining member has a surface 70 which engages rear face 68 of coin 32 and a surface 72 defining an opening in retaining member 36 in which coin 32 is placed. The dimension defined by surface 72 is sized to be substantially the same or slightly larger than the dimension of coin 32 so that coin 32 fits snugly into the opening defined by surface 72. As one of ordinary skill in the art will appreciate, for retaining member 36 to be removable section 64 must have room to flex so that detent 58 can be disengaged from detent 56 on bezel 34. For this reason, it is important that the opening defined by surface 72 is sized to allow section 64 to flex sufficiently to allow retaining member 36 to be removable. It is contemplated that coin 32 is held snugly in place, that is, with the top of the coin, defined by the top of the impression on the coin, directed to the top of the buckle or display structure, by providing a snug fit between surface 70 on retaining member 36 and surface 54 on bezel 34. It is also contemplated that a clear protective film (not shown) could be disposed between the rear face 68 of coin 32 and surface 70 for protection of rear face 68.

Figure 6:
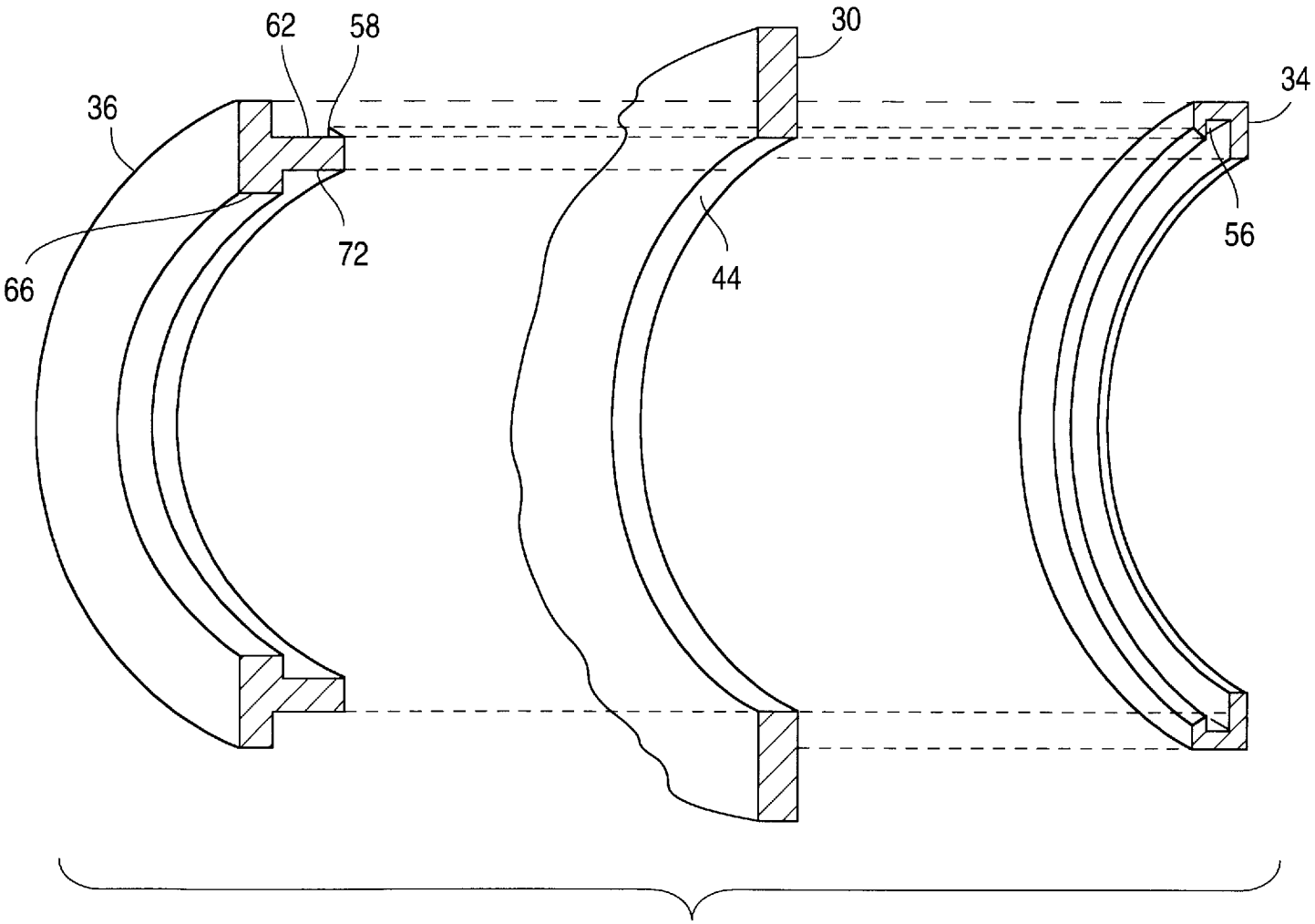
FIG. 6 is an exploded view of a section of the coin retaining device shown in FIG. 2.

Referring now to FIG. 6, there is an exploded view showing how bezel 34, buckle 30 and retaining member 36 are intended to fit together. As can be seen, when retaining member 36 is inserted into buckle 30 surface 62 will fit flush against surface 44. This requires detent 58 which has a larger dimension than surface 44 on buckle 30 to flex sufficiently to fit through the opening in buckle 30. Once retaining member 36 is through the opening detent 58 engages detent 56 on bezel 34. Because bezel 34 is typically made of a decorative material such as metal it is rigid which will require the retaining member material to flex so that detent 58 will be insertable through and engage detent 56 to hold bezel 34 in position outside the opening in buckle 30. The coin (not shown in FIG. 6) is held in the opening defined by annular surface 72.

Figure 7:
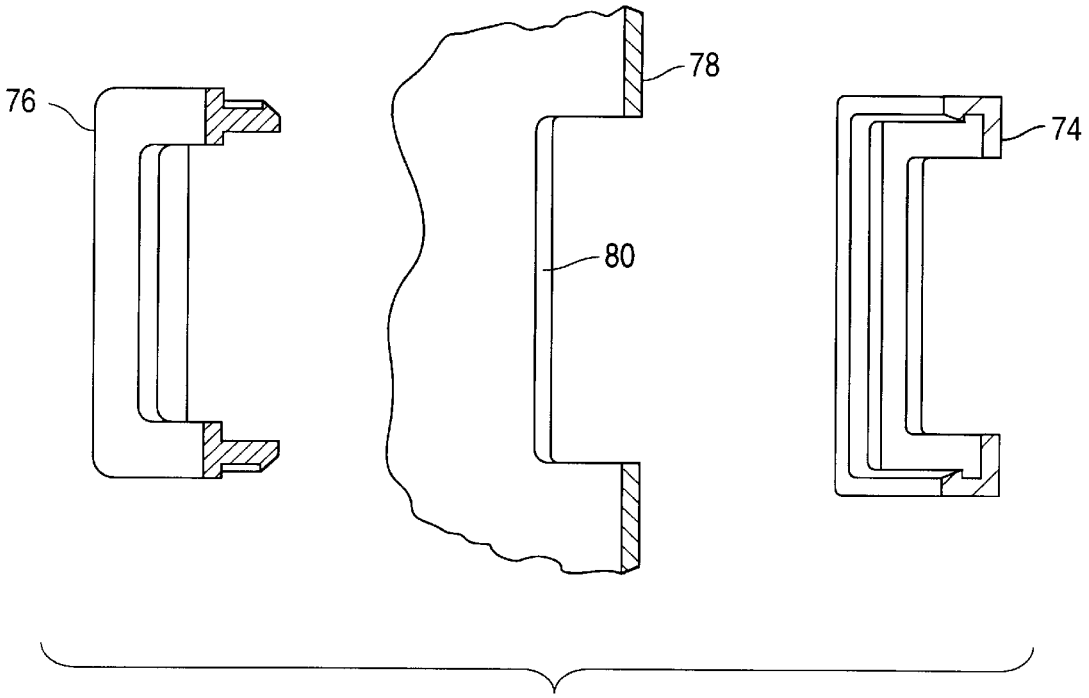
FIG. 7 is an exploded view of a second embodiment of the present invention.
Figure 8:
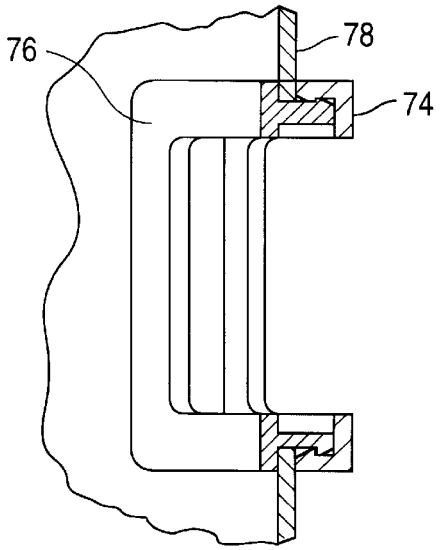
FIG. 8 shows the embodiment shown in FIG. 7 as it would be attached to a display device.

Referring now to FIG. 7 there is shown an exploded view of a second embodiment of the present invention. The second embodiment comprises a bezel 74, a retaining member 76, and a display structure 78. The second embodiment illustrates an opening with a square opening defined by surface 80 in display structure 78. It is to be understood that other geometrically shaped openings are contemplated by the present invention. FIG. 8 shows the second embodiment shown in FIG. 7 as it would be assembled on display structure 78.

Figure 9A:
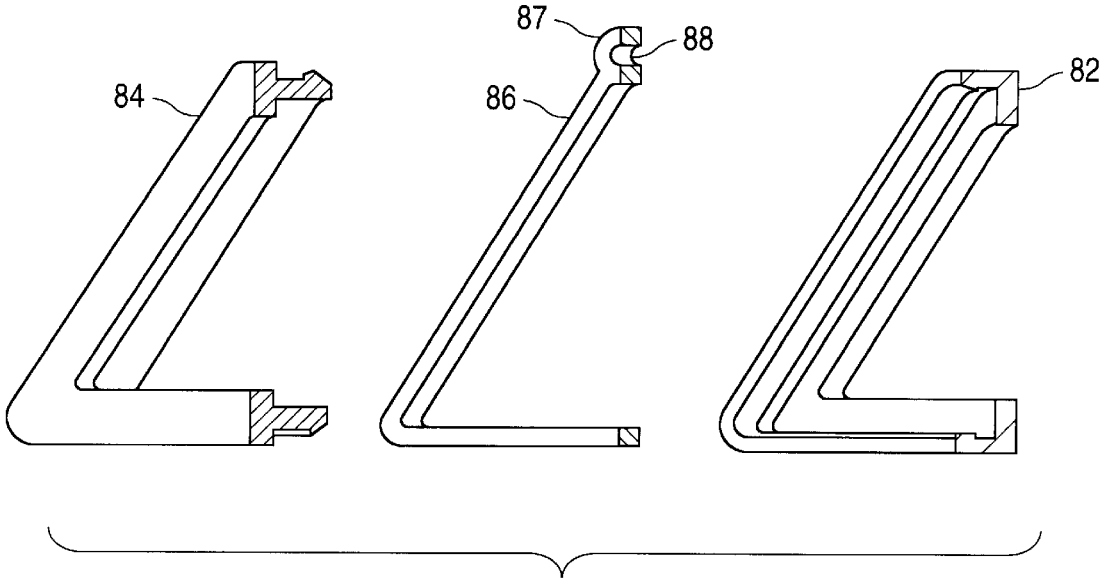
FIG. 9A is an exploded view of a third embodiment of the present invention.
Figure 9B:
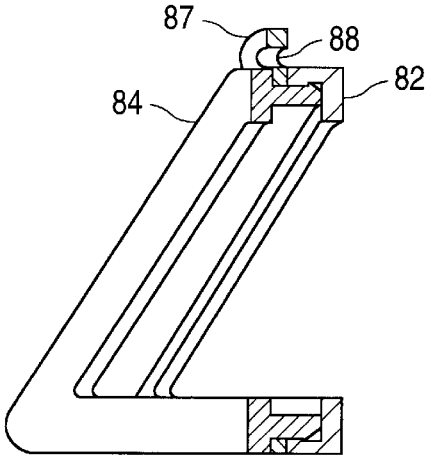
FIG. 9B shows the embodiment shown in FIG. 9A as it would be attached to a display device.
Figure 10A:
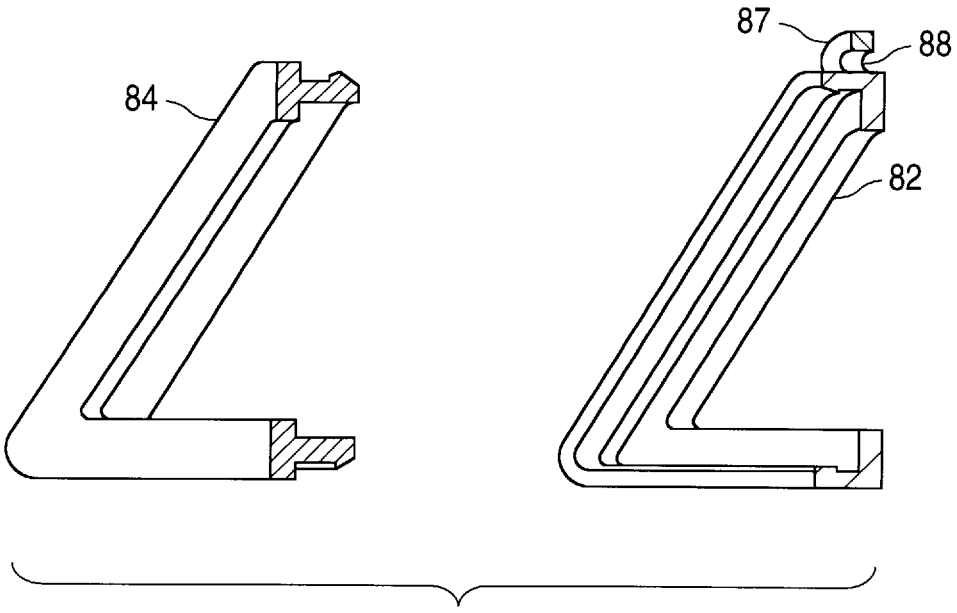
FIG. 10A is an exploded view of a fourth embodiment of the present invention.
Figure 10B:
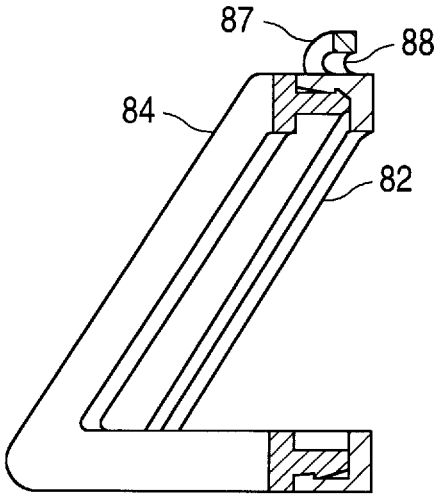
FIG. 10B shows the embodiment shown in FIG. 10A as it would be attached to a display device.

Referring now to FIG. 9A there is shown an exploded view of a third embodiment of the present invention. The third embodiment comprises a bezel 82, a retaining member 84, and a mounting structure 86. Mounting structure 86 has a structure 87 with an opening 88 through which a chain or the like can be threaded through for suspending the mounting structure 86 as a necklace or on a charm bracelet or the like. FIG. 9B shows the third embodiment shown in FIG. 9A as it would be assembled on display structure 86.

Referring now to FIG. 1OA there is shown an exploded view of a fourth embodiment of the present invention. The fourth embodiment is very similar to the third embodiment shown in FIGS. 9A and 9B, however, in the fourth embodiment the structure 87 is attached to bezel 82 and the mounting structure 86 (FIGS. 9A and 9B) is not needed in the fourth embodiment. FIG. 1OB shows the fourth embodiment shown in FIG. 1OA as it would be assembled.

Figure 11A:
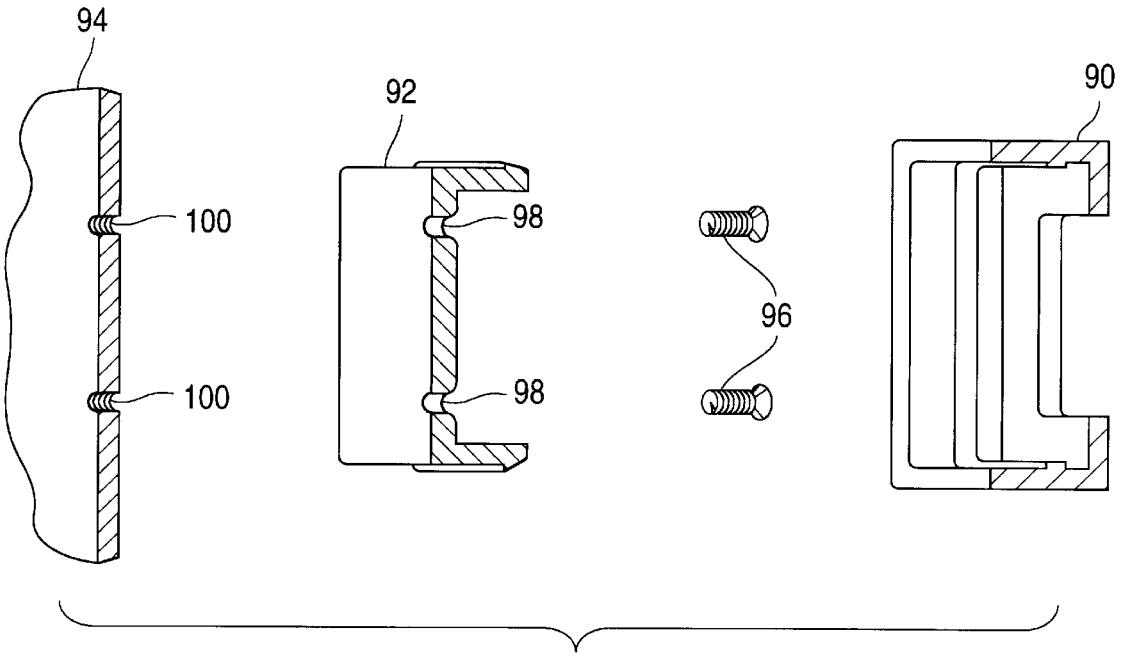
FIG. 11A is an exploded view of a fifth embodiment of the present invention.
Figure 11B:
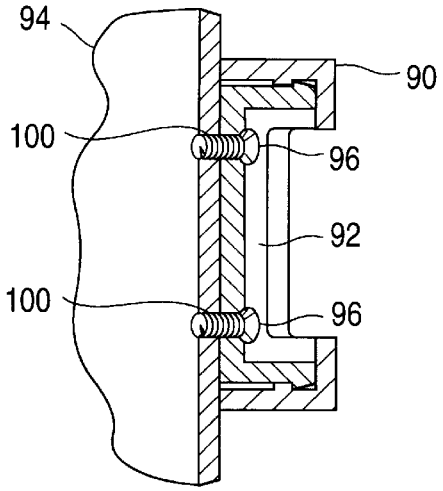
FIG. 11B shows the embodiment shown in FIG. 11A as it would be attached to a display device.

Referring now to FIG. 11A there is shown an exploded view of a fifth embodiment of the present invention. The fifth embodiment comprises a bezel 90, a retaining member 92, and a display structure 94. In the fifth embodiment retaining member 92 is attached to display structure 94. Shown in FIG. 11A, retaining member 92 is attached to display structure 94 by screws 96 inserted through openings 98 in retaining member 92 into threaded openings 100 in display structure 94. It should be appreciated by one of ordinary skill in this art that the retaining member 92 could be attached to display structure 94 by rivets or the like. FIG. 1B shows the fifth embodiment shown in FIG. 11A as it would be assembled on display structure 94.

Figure 12A:
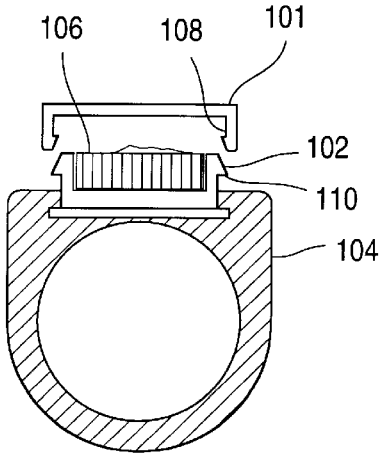
FIG. 12A shows an exploded view of a sixth embodiment of the present invention.
Figure 12B:
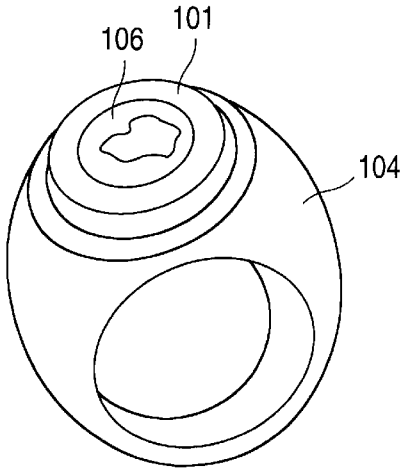
FIG. 12B shows the embodiment shown in FIG. 12A in an assembled form.

Referring now to FIG. 12A there is shown an exploded view of a sixth embodiment of the present invention. The sixth embodiment comprises a bezel 101, a retaining member 102, and a display structure 104. In the sixth embodiment the display structure 104 is a ring and as shown in FIG. 12A the artifact being displayed is a coin 106. Bezel 101 has a detent 108 which is engageable with a detent 110 on retaining member 102. FIG. 12B shows the sixth embodiment shown in FIG. 12A as it would be assembled. It should be appreciated that other types of artifacts other than a coin could be displayed in the ring.

Figure 13A:
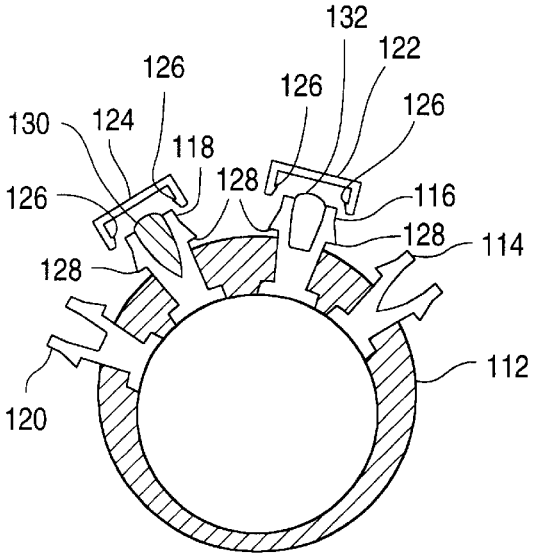
FIG. 13A shows an exploded view of a seventh embodiment of the present invention.
Figure 13B:
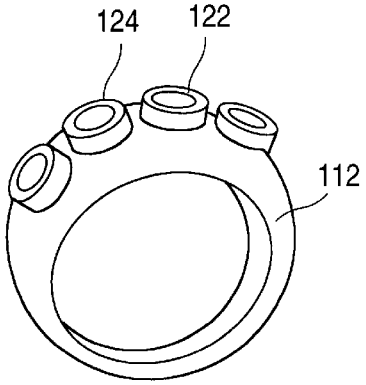
FIG. 13B shows the embodiment shown in FIG. 13A in an assembled form.

Referring now to FIG. 13A there is shown a seventh embodiment of the present invention. The seventh embodiment is similar to the sixth embodiment in that the display structure is a ring. However, in the seventh embodiment there are shown four structures to display artifacts. The display structure 112 comprising a ring is shown with four retaining members 114, 116, 118, and 120. There are shown two bezels 122 and 124 which would engage retaining members 116 and 118 respectively. Bezels 122 and 124 each have a detent 126 which is engageable with a detent 128 on retaining members 116 and 118. Shown for illustrative purposes is a jewel 130 in retaining member 118 and a stone 132 in retaining member 116. There are not shown bezels for retaining members 114 or 120 for clarity reasons, however, it should be appreciated that each retaining member would have a bezel in place when assembled as shown in FIG. 13B.

The foregoing description of the preferred embodiments of the present invention has been presented for purposes of illustration and description. It is not intended to be exhaustive or to limit the invention to the precise forms disclosed. Obvious modifications or variations are possible in light of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What I claim is:

1. An artifact retaining device for retaining one or more artifacts such as coins, jewels, stones, or other type mementos in a display structure, said display structure having a front and a rear surface and an opening therethrough, said artifact retaining device comprising:

a bezel; and a retaining member having a first surface for engaging said display structure, said retaining member engageable with said bezel to retain said bezel with respect to said opening.

2. The device of claim 1, wherein:

said bezel has a first detent; and said retaining member has a first detent engageable with said first detent in said bezel.

3. The device of claim 2, wherein:

said bezel has a first inner surface defining a display window; and said bezel has a first surface for engaging the front surface of said display structure.

4. The device of claim 3, wherein said first surface of said retaining member is formed for engaging the rear surface of said display structure.

5. The device of claim 4, wherein said retaining member has a section for extending through said opening, said section having an outer surface with a dimension sized to fit within said opening.

6. The device of claim 5, wherein said retaining member has a first inner surface defining a first opening with a dimension sized to allow said artifact to fit therein.

7. The device of claim 6, wherein said retaining member has a second inner surface defining a second opening in said retaining member.

8. The device of claim 7, wherein said retaining member has a second surface to engage a rear surface of said artifact.

9. The device of claim 8, wherein said bezel has a second surface to engage a front surface of said artifact.

10. The device of claim 9, wherein said second surface of said retaining member has a dimension sized to allow an artifact to fit between said second surface of said retaining member and said second surface of said bezel.

11. The device of claim 10, wherein said retaining member and said bezel are removable.

* * * * *